US008116648B2

(12) United States Patent
Takiguchi

(10) Patent No.: US 8,116,648 B2
(45) Date of Patent: Feb. 14, 2012

(54) IMAGE FORMING APPARATUS

(75) Inventor: Toshiki Takiguchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 365 days.

(21) Appl. No.: 12/395,658

(22) Filed: Feb. 28, 2009

(65) Prior Publication Data

US 2009/0220258 A1 Sep. 3, 2009

(30) Foreign Application Priority Data

Mar. 3, 2008 (JP) ..... 2008-052673

(51) Int. Cl.
*G03G 15/16* (2006.01)

(52) U.S. Cl. ..... 399/66; 399/43; 399/101; 399/350

(58) Field of Classification Search ..... 399/43, 399/71, 101, 121, 297, 303, 310, 313, 314, 399/343, 350, 66
See application file for complete search history.

(56) References Cited

U.S. PATENT DOCUMENTS 5,191,378 A * 3/1993 Itaya et al. ..... 399/313
5,574,550 A * 11/1996 Okazaki et al. ..... 399/313
6,212,351 B1 * 4/2001 Kawagoe et al. ..... 399/302
6,219,496 B1 4/2001 Kojima et al.
2002/0009314 A1 * 1/2002 Nakayama ..... 399/297

FOREIGN PATENT DOCUMENTS

| | | |
|---|---|---|
| JP | 11-109827 | 4/1999 |
| JP | 2000-181186 | 6/2000 |
| JP | 2004-252295 | 9/2004 |
| JP | 2005-043533 | 2/2005 |
| JP | 2006-023417 | 1/2006 |
| JP | 2006-337721 | 12/2006 |

* cited by examiner

*Primary Examiner* — David Porta
*Assistant Examiner* — Benjamin Schmitt
(74) *Attorney, Agent, or Firm* — Renner, Otto, Boisselle & Sklar, LLP

(57) ABSTRACT

An image forming apparatus is provided. When a user inputs a print request, life count values stored in a life management section are read out. A table of correlation between the life count values and a rotating speed of a driving roller is looked up, a rotating speed of the driving roller corresponding to the life count values read out is determined at which the driving roller is set to rotate. With the driving roller rotating at the set rotating speed, a printing process is performed so that a transfer belt turns at a constant running speed. Following the printing process, the life count values are updated based on the latest total number of printed copies and the latest revolving speed of the transfer belt.

7 Claims, 5 Drawing Sheets

IMAGE FORMING APPARATUS

CROSS-REFERENCE TO RELATED APPLICATION

This application claims priority to Japanese Patent Application No. 2008-052673, which was filed on Mar. 3, 2008, the contents of which are incorporated herein by reference in its entirety.

BACKGROUND OF THE INVENTION

1. Field of the Invention

The present invention relates to an image forming apparatus having a transfer unit for transferring to a recording medium a toner image developed on a photoreceptor.

2. Description of the Related Art

An image forming apparatus employing an electrophotographic process generally includes a photoreceptor serving as an image bearing member which rotates, and a charging section, an exposure section, a developing section, a transfer section, a fixing section, a cleaning section, and an electricity removing section which are arranged around the photoreceptor. The charging section uniformly charges a surface of the photoreceptor. The exposure section irradiates the charged surface of the photoreceptor with light according to the image information and thereby forms an electrostatic latent image. The developing section stirs a toner therein to cause friction which electrifies the toner so that the toner is attached to the electrostatic latent image formed on the surface of the photoreceptor, and thereby forms a toner image. The transfer section provides a recording medium with charges of which polarity is opposite to that of the charges in the toner and thereby transfers the toner image to the recording medium. The fixing section fixes the transferred toner image to the recording medium with heat, pressure, or the like means. The cleaning section collects the toner which has failed to be transferred and thus remains on the surface of the photoreceptor. The electricity removing section removes the electricity of the photoreceptor, which remains after transferring of the toner image. The image forming apparatus employing the electrophotographic process constructed as above forms desired images on recording mediums.

A transfer unit, which serves as the transfer section for transferring the toner image from the photoreceptor to the recording medium, is composed of a transfer belt, a plurality of rollers on which the transfer belt is suspended in a tensioned manner and which turns the transfer belt around, and a transfer roller to which is applied an electric field having an opposite polarity to that of the charges of the toner image on the surface of the photoreceptor so that the toner image is transferred to recording paper on the transfer belt. The toner image on the photoreceptor is transferred to the recording paper conveyed to the running transfer belt.

In forming a color image in the electrophotographic process, toners of plural colors; for example, black (K), cyan (C), magenta (M), and yellow (Y), are used. In a color image forming apparatus, a structure having a photoreceptor as a center with other various sections such as those stated above, is provided for each color and a toner image is formed for every color. The toner images of all colors are transferred to a recording medium to be overlaid with each other and then fixed to the recording medium. A color image can be thus formed by subtractive color mixture.

To an intermediate transfer belt, toner images of respective colors are transferred in a manner that these images are sequentially overlaid with each other, thereby forming a multicolored toner image which will be then transferred to a recording medium.

In order to form images in such constitution as above, it is necessary to accurately adjust a rotating speed of each photoreceptor and a running speed of the transfer belt. An adjustment failure will lead to such transfer misregistration as position displacement of an image transferred to a recording medium, or deviation of image magnification, and in the case of forming color images, misregistration in overlaying toner images.

In an image forming apparatus disclosed in Japanese Unexamined Patent Publication JP-A 11-109827 (1999), one of a scanning speed of an exposure section, a rotating speed of an image bearing member, and a revolving speed of an intermediate transfer member, is controlled based on a count value, i.e., the number of sheets on which images have been printed, a temperature, and the like factor, in order to reduce fluctuation of the image magnification depending on durability of the intermediate transfer member as well as to reduce image change due to variation in electric resistance of the intermediate transfer member.

In an image forming apparatus disclosed in Japanese Unexamined Patent Publication JP-A 2004-252295, a revolving speed of a belt is directly measured at a transfer position and on the basis of the measurement result, the moving speed of the belt is controlled, in order to reduce position displacement of an image in spite of a change in thickness of, the elongation and vibration, etc. of the belt.

A toner may be attached to not only a photoreceptor but also a transfer belt, and this is why a cleaning section for transfer belt is provided to remove the toner attached to the transfer belt. A commonly-known cleaning section is composed of a cleaning blade which is made of an elastic material such as urethane rubber and disposed in contact with a surface of the transfer belt so as to scrape off the toner attached thereto.

For the transfer belt, a material having surface roughness Rz of around 6 μm is selected, and as the cleaning operation is performed with the cleaning blade in contact with the transfer belt, its microabrasion action undesirably causes the transfer belt to be gradually abraded away, resulting in the transfer belt having the surface roughness Rz of around 1 μm.

As the transfer belt has decreased surface roughness Rz, a frictional force increases at a contact portion between the cleaning blade and the transfer belt, and the cleaning blade may work as a brake, lowering the running speed of the transfer belt.

This causes mismatching between the rotating speed of the photoreceptor and the running speed of the transfer belt, which leads to some transfer misregistration.

In the image forming apparatus disclosed in JP-A 11-109827, the speed deterioration of the transfer belt due to the change in its surface roughness is not taken into consideration. In the image forming apparatus disclosed in JP-A 2004-252295 in which the speed of the belt is directly measured, it is possible to deal with the speed deterioration of the transfer belt due to the change in its surface roughness, but at the same time, it is necessary to provide a measurement section for directly measuring the speed of the belt.

SUMMARY OF THE INVENTION

An object of the invention is to provide an image forming apparatus with a simple structure in which a frictional force between a cleaning blade and transfer belt does not reduce a speed of a transfer belt.

The invention provides an image forming apparatus comprising a transfer unit for transferring to a recording medium a toner image developed on a photoreceptor, the transfer unit having a transfer belt conveying the recording medium, and the image forming apparatus comprising:

a cleaning section for cleaning a surface of the transfer belt by coming into contact therewith; and a control section for controlling a running speed of the transfer belt based on a change in frictional force at a contact portion between the transfer belt and the cleaning section.

According to the invention, the control section controls the running speed of the transfer belt based on the change in frictional force at the contact portion between the transfer belt and the cleaning section.

Consequently, the increasing frictional force does not cause a decrease in the running speed of the transfer belt, with the result that the transfer belt can maintain its running speed at a constant level, thus allowing for formation of high-quality images without transfer misregistration.

Further, in the invention, it is preferable that the control section controls the running speed based on a correlation among the change in frictional force, a cumulative number of printed copies, and a distance that the transfer belt has run.

According to the invention, the control section controls the running speed based on the correlation among the change in frictional force, a cumulative number of printed copies, and the distance that the transfer belt has run.

The frictional force changes because the cleaning section scrubs the surface of the transfer belt of which surface roughness therefore changes. The change in friction force is therefore temporal change. Accordingly, the change in frictional force is correlated with the cumulative number of printed copies, the distance that the transfer belt has run, or the like factor relating to the temporal change, which is so-called a life count value.

Consequently, the use of the life count value enables the control on the running speed of the transfer belt in a simpler structure.

Further, in the invention, it is preferable that the control section controls the running speed for every predetermined increase in an cumulative number of printed copies or for every predetermined increase in a running distance of the transfer belt.

According to the invention, the control section controls the running speed for every predetermined increase in the cumulative number of printed copies or for every predetermined increase in the running distance of the transfer belt.

The frictional force changes so relatively slowly that these controls carried out at intervals of predetermined increase are enough to achieve accurate control as a whole.

Further, in the invention, it is preferable that the control section controls the transfer belt so that its running speed becomes equal to a circumferential speed of the photoreceptor.

According to the invention, the control section controls the transfer belt so that its running speed becomes equal to the circumferential speed of the photoreceptor. If the running speed of the transfer belt is slower than the circumferential speed of the photoreceptor, paper jam may occur. It is therefore preferable that the running speed of the transfer belt is set to be equal to, or at least around 1% higher than, the circumferential speed of the photoreceptor.

Further, in the invention, it is preferable that the transfer belt is composed of an endless belt member, and the running speed of the transfer belt is a revolving speed of the transfer belt.

According to the invention, the transfer belt is composed of an endless belt member, and the running speed of the transfer belt is the revolving speed of the transfer belt.

This makes it possible to easily control the running speed of the transfer belt by controlling only a rotating speed of a driving roller for turning the transfer belt.

Further, in the invention, it is preferable that the cleaning section has a plate-shaped cleaning blade made of urethane rubber and performs cleaning by bringing the cleaning blade into contact with the transfer belt.

According to the invention, the cleaning blade is used to clean the surface of the transfer belt.

The invention provides an image forming apparatus comprising a transfer unit for transferring to a recording medium a toner image developed on a photoreceptor, the transfer unit having a transfer belt conveying the recording medium, and the image forming apparatus comprising:

a cleaning section for cleaning a surface of the transfer belt by coming into contact therewith; and a control section for controlling a running speed of the transfer belt based on a change in contact condition of the transfer belt and the cleaning section.

According to the invention, the control section controls the running speed of the transfer belt based on the change in contact condition of the transfer belt and the cleaning section.

This makes it possible to prevent the transfer belt from losing speed even when the transfer belt and the cleaning section come into contact with each other in a different way, so that the transfer belt can maintain its running speed at a constant level, which allows for formation of high-quality images without transfer misregistration.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
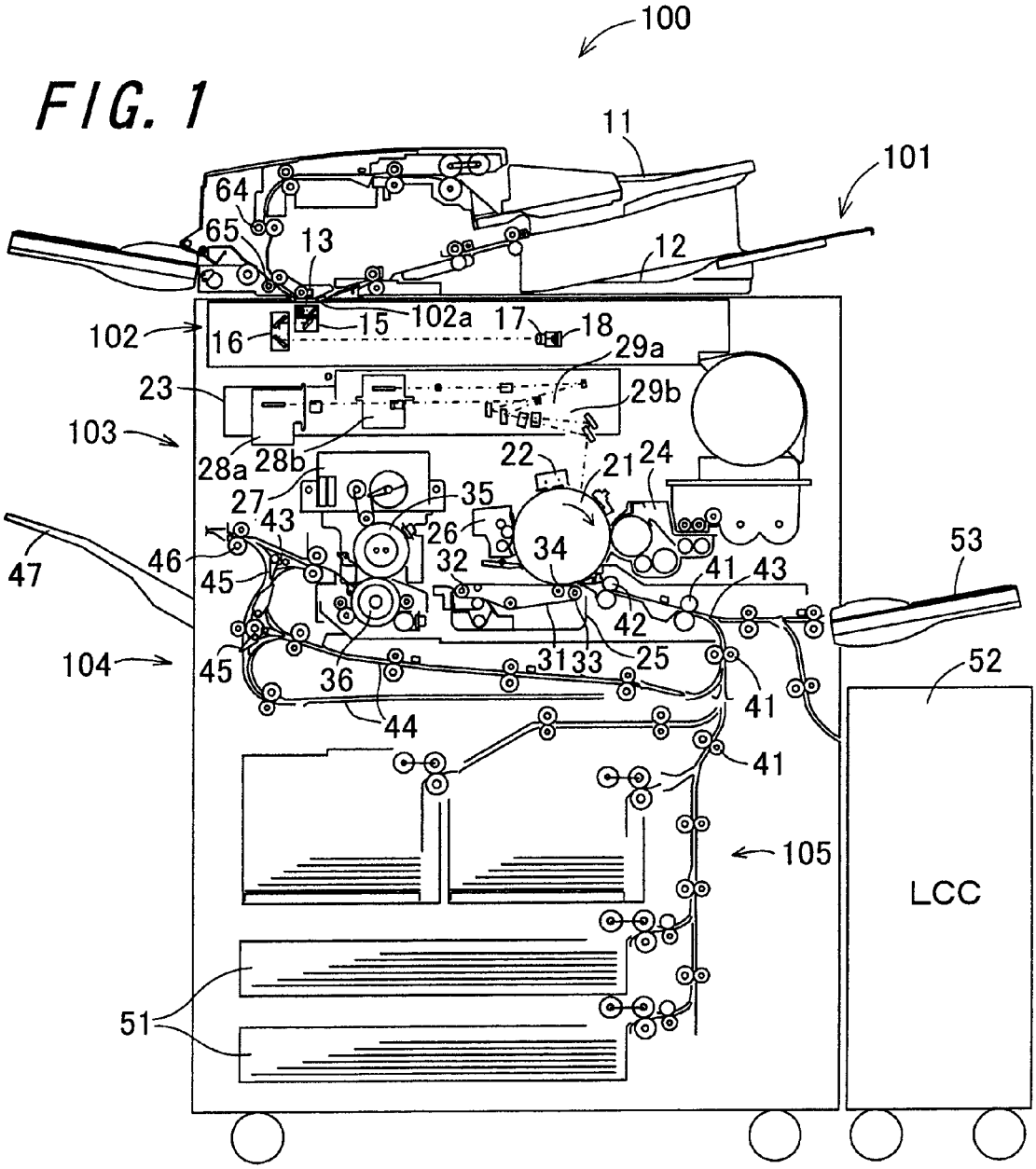
FIG. 1 is a view showing a configuration of an image forming apparatus according to one embodiment of the invention.

Now referring to the drawings, preferred embodiments of the invention are described below.

FIG. 1 shows a view showing a configuration of an image forming apparatus 100 according to one embodiment of the invention.

The image forming apparatus 100 obtains image data read on document paper or image data received from external equipment, and forms monochrome images on recording paper according to the obtained image data. The image forming apparatus 100 roughly comprises an automatic document feeder (abbreviated as ADF) 101, an image reading section 102, a printing section 103, a recording paper conveying section 104, and a paper feeding section 105.

In the automatic document feeder 101, when document paper, at least one in number, is placed on a document placement tray 11, the document paper is pulled and thereby introduced therefrom sheet by sheet into a document reading slot 102*a* of the image reading section 102, through which the document paper is conveyed to be discharged onto a catch tray 12.

Above the document reading slot 102*a*, a contact image sensor (abbreviated as CIS) 13 is disposed. This CIS 13 repeatedly reads in a main scanning direction an image formed on the back side of the document paper passing through the document reading slot 102*a*, and outputs image data of the image formed on the back side of the document paper.

In the image reading section 102, the front side of the recording paper passing through the document reading slot 102*a* is irradiated with light of a lamp in the first scanning unit 15, and the light reflected from the front side of the document paper is led by mirrors in the first and second scanning units 15 and 16 to an imaging lens 17 which is thus used to produce on a charge coupled device (abbreviated as CCD) image sensor 18 an image formed on the front side of the document paper. The CCD image sensor 18 repeatedly reads in the main scanning direction the image formed on the front side of the document paper and outputs the image data of the image formed on the front side of the document paper. It is thus possible to read images on both sides of the document paper.

Furthermore, in the case where the document paper is placed on a platen glass on top of the image reading section 102, the first scanning unit 15 and the second scanning unit 16 are moved with their predetermined mutual speed relationship maintained so that the front side of the document paper placed on the platen glass is irradiated with light of the first scanning unit 15 and that the light reflected from the front side of the document paper is then led by the first and second scanning units 15 and 16 to the imaging lens 17 which is thus used to produce on the CCD image sensor 18 an image formed on the front side of the document paper.

The image data to be outputted from the CIS 13 or CCD image sensor 18 is subjected to various image processing in control circuits such as a microcomputer, before being outputted to the printing section 103.

The printing section 103, which forms images on recording paper according to image data, includes a photoreceptor 21, a charger 22, an optical writing unit 23, a developing device 24, a transfer unit 25, a cleaning unit 26, and a fixing unit 27.

The photoreceptor drum 21 rotates in a single direction and has its surface cleaned by the cleaning unit 26 and then uniformly charged by the charger 22. The charger 22 may be a non-contact charger-type charger or a contact roller-type or brush-type charger which comes into contact with the photoreceptor drum 21 to electrify it.

The optical writing unit 23 is a laser scanning unit (LSU) having two laser emitting portions 28*a* and 28*b* and two mirror groups 29*a* and 29*b*. In the optical writing unit 23, laser light according to image data inputted thereto is emitted from each of the laser emitting portions 28*a* and 28*b* and this laser light is then led to the photoreceptor drum 21 by way of each of the mirror groups 29*a* and 29*b* so that the uniformly charged surface of the photoreceptor drum 21 is exposed to the laser light, thereby forming an electrostatic latent image on the surface of the photoreceptor drum 21.

To deal with the high-speed printing process, the optical writing unit 23 adopts a two beam system with the two laser emitting portions 28*a* and 28*b*, to thereby lessen a burden associated with faster irradiation timing.

Note that for the optical writing unit 23, the laser scanning unit may be replaced by an EL or LED writing head with an array of light-emitting elements.

The developing device 24 supplies the toner to the surface of the photoreceptor drum 21 to develop the electrostatic latent image, thereby forming a toner image on the surface of the photoreceptor drum 21. The transfer unit 25 transfers the toner image on the surface of the photoreceptor drum 21 to recording paper conveyed by the paper conveying section 104. The fixing unit 27 heats and pressurizes the recording paper so that the toner image thereon is fixed into place. After that, the recording paper is further conveyed by the paper conveying section 104 to a catch tray 47 where the recording paper is discharged. In addition, the cleaning unit 26 removes and collects a toner which remains on the surface of the photoreceptor drum 21 after the development and transfer operations.

A conductive elastic roller 34 is pressed against the surface of the photoreceptor drum 21 with the transfer belt 31 therebetween, with the result that the recording medium conveyed to the transfer belt 31 is pressed against the surface of the photoreceptor drum 21. This conductive elastic roller 34 has an electric field of which polarity is opposite to that of charges in the toner image formed on the surface of the photoreceptor drum 21. Owing to this electric field of opposite polarity, the toner image on the surface of the photoreceptor drum 21 is transferred to the recording paper on the transfer belt 31. For examples, a positive (+) electric field is applied across the conductive elastic roller 34 when the toner image is negatively charged; or has minus (−) charges.

The fixing unit 27 has a heat roller 35 and a pressure roller 36. Inside the heat roller 35, a heat source is provided to heat a surface of the heat roller 35 to a predetermined temperature (the fixing temperature of around 160° C. to 200° C.). Further, a pressure member (not shown) is disposed on either side of the pressure roller 36 so that the pressure roller 36 comes into contact with the heat roller 35 at a predetermined pressure. The recording paper conveyed to a pressure-contact portion (referred to as a fixing nip portion) between the heat roller 35 and the pressure roller 36 is further conveyed by theses rollers 35 and 36 while an unfixed toner image on the recording paper is molten by heat and pressurized so that the toner image is fixed onto the recording paper.

The paper conveying section 104 includes plural pairs of conveying rollers 41 for conveying recording paper, a pair of registration rollers 42, a conveying path 43, a reversal conveying path 44, a plurality of branch pawls 45, and a pair of paper discharge roller 46.

The recording paper is conveyed from the paper feeding section 105 to the conveying path 43 along which the recording paper is further conveyed until a leading end of the recording paper reaches the registration rollers 42. At this time, the registration rollers 42 are temporarily halted, so that the recording paper curves with its leading end in contact with the registration rollers 42. Using elastic force of this curved recording paper, the leading end of the recording paper and the registration rollers 42 are aligned in parallel with each other. After this, the registration rollers 42 start to rotate and thereby convey the recording paper to the transfer unit 25 in the printing section 103, and the recording paper is then conveyed by the paper discharge roller 46 further to the catch tray 47.

The registration rollers 42 each start and stop rotating by engaging and disengaging a clutch arranged between the registration roller 42 and its drive shaft or by switching on and off a motor which serves as a drive source of the registration roller 42.

Moreover, in the case of recording an image on the back side of the recording paper as well, the plurality of branch pawls 45 turn to change routes of the conveying path 43 and the reversal conveying path 44 so that the recording paper is turned over in the reversal conveying path 44 and conveyed therein back to the registration rollers 42 in the conveying path 43. An image is thus recorded also on the back side of the recording paper.

Along the conveying path 43 and the reversal conveying path 44, sensors for detecting a position, etc. of the recording paper are provided in various positions. On the basis of the position of recording paper detected by these sensors, the conveying rollers and the registration rollers are driven under control for conveying and positioning the recording paper.

The paper feeding section 105 has a plurality of paper feeding trays 51. The paper feeding trays 51 are each used for storing recording paper and disposed in a lower part of the image forming apparatus 100. Each of the paper feeding trays 51 is provided with pickup rollers or the like component for pulling out the recording paper sheet by sheet, and the recording paper pulled out is then delivered to the conveying path 43 in the paper conveying section 104.

Since the image forming apparatus 100 according to the present embodiment aims for high-speed printing process, the paper feeding trays 51 each have a capacity for 500 to 1,500 sheets of standard-size recording paper.

Moreover, on a lateral surface of the image forming apparatus 100, a large capacity cassette (abbreviated as LCC) 52 is provided to store large piles of recording paper of different types, and a manual tray 53 is also provided to mainly feed nonstandard size recording paper.

The catch tray 47 is located on the other lateral surface of the image forming apparatus 100 than the lateral surface thereof on which the manual tray 53 is located. Instead of this catch tray 47, an aftertreatment (e.g. stapling or punching) device for discharged paper, or a plurality of catch trays may be disposed as an option.

Figure 2:
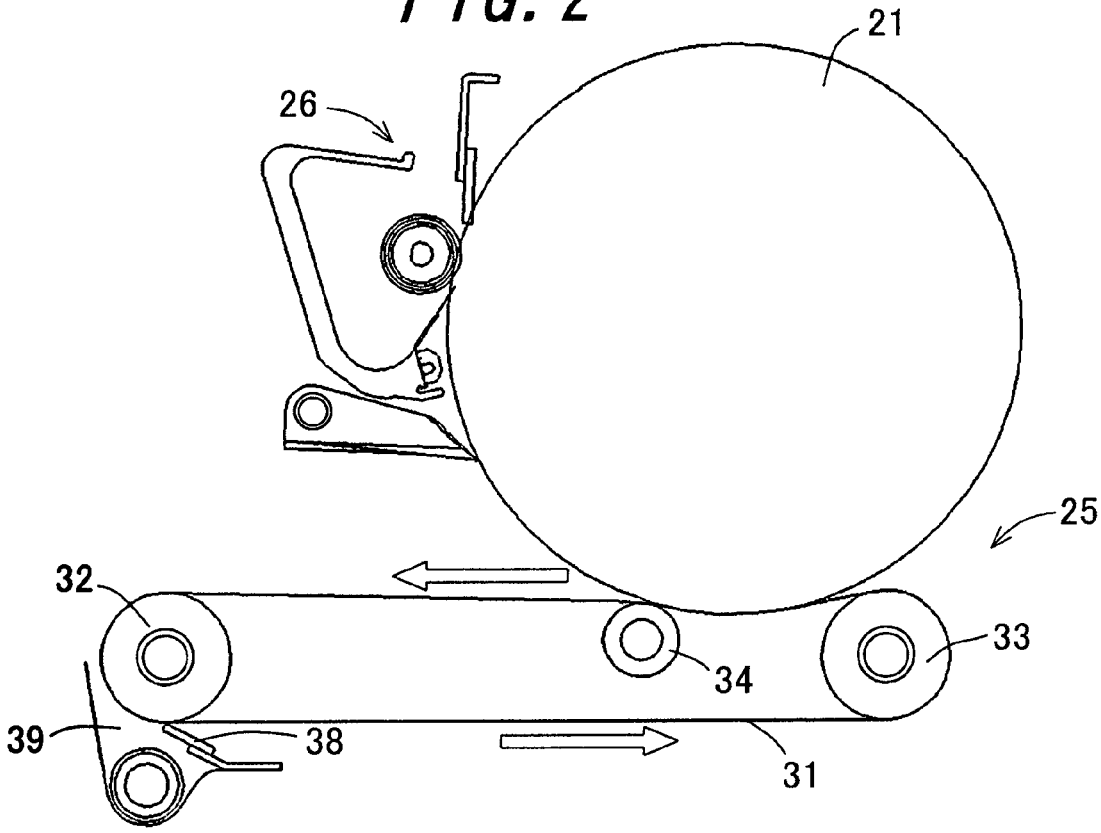
FIG. 2 is an enlarged fragmentary view of a transfer unit in the image forming apparatus.

FIG. 2 is an enlarged fragmentary view of the transfer unit 25 in the image forming apparatus 100.

The transfer unit 25 has the transfer belt 31, a driving roller 32, a driven roller 33, and the conductive elastic roller 34. The transfer belt is suspended and turned around in a tensioned manner on these rollers 32 to 34 and the other rollers. The transfer belt 31 is formed of an endless belt member with predetermined resistance (of $1\times10^{9}$ to $1\times10^{13}$ Ω/cm, for example), and carries the recording paper on its surface.

For the transfer belt 31, a resin material so flexible but hardly stretchable that the transfer belt 31 can smoothly turn, is generally selected and formed into a film. The resin material as above includes heretofore known thermoplastic resin, thermoplastic elastomer, and thermosetting resin.

The transfer belt 31 is produced to have predetermined surface roughness in view of a releasing property of the recording paper to be conveyed by the transfer belt 31.

The surface roughness is expressed by the roughness average (Ra) of center lines, the highest peak (Rmax), or the 10 point average roughness (Rz), of all sample parts selected at random in a surface. For the transfer belt 31, a belt having 10 point average roughness (Rz) of around 1 μm to 7 μm is used, for example.

Below the driving roller, a cleaning unit for transfer belt (namely, transfer cleaning unit) 37 is disposed. The transfer cleaning unit 37 has a cleaning blade 38 and a removed-toner box 39 for accumulating the toner removed. The cleaning blade 38 is made of plate-shaped resin, such as urethane rubber, having moderate hardness and elasticity.

The cleaning blade 38 comes into contact with the transfer belt 31 to scrape off and thereby remove the toner attached to the surface of the transfer belt 31. The difference in material hardness between the cleaning blade 38 and the transfer belt 31 causes the surface of the transfer belt 31 to be ground by the cleaning blade 38. The abrasion on the surface of the transfer belt 31 indicates a decrease in its surface roughness.

The transfer belt 31 which is an elastic rubber belt with its surface layer coated with a fluorinated resin and has initial surface roughness Rz of 6 μm, operates with the cleaning blade 38 made of urethane rubber to print about 200,000 to 300,000 copies, that is to say, makes about 200,000 to 300,000 revolutions, and then it turns out that the surface roughness Rz of the transfer belt 31 has decreased to 1 μm.

As the transfer belt 31 has decreased surface roughness, a frictional force increases between the cleaning blade 38 and the transfer belt 31, and the cleaning blade may work as a brake, lowering the running speed of the transfer belt 31.

In the invention, how much speed the transfer belt 31 will lose is predicted, and the rotating speed of the driving roller 32 is adjusted so as not to cause a decrease in speed. To be specific, changes in speed decrease over time without adjustment have been measured in advance, and referring to this measurement result, the rotating speed of the driving roller 32 is increased so that the transfer belt 31 runs at constant speed.

Figure 3:
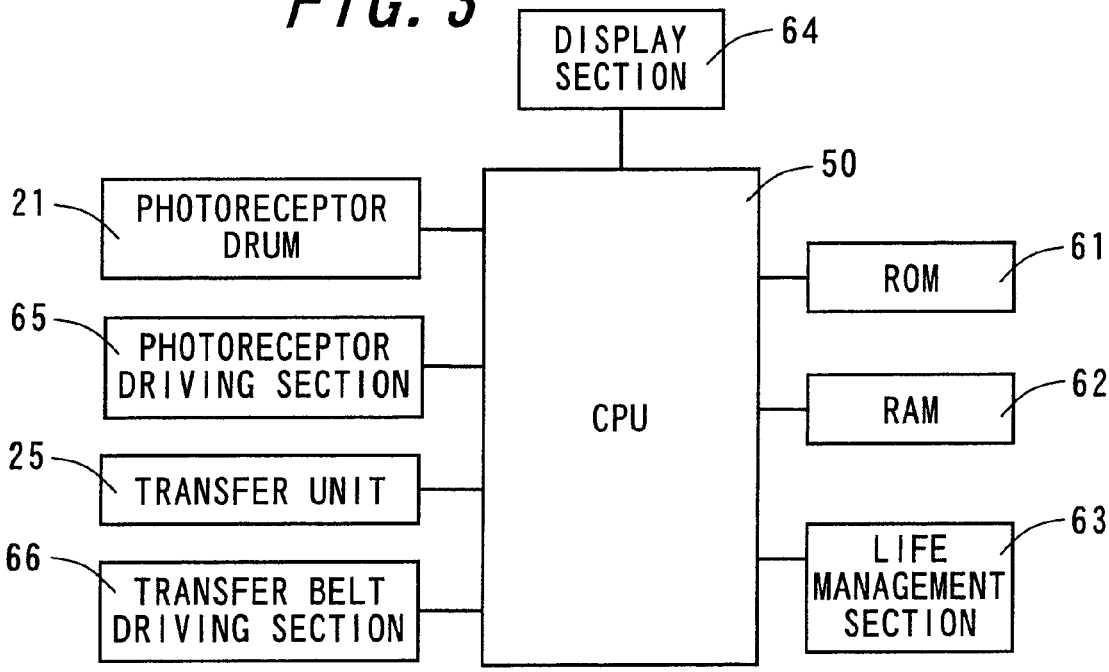
FIG. 3 is a block diagram showing an electric configuration of components relevant to a control on the transfer unit in the image forming apparatus.

FIG. 3 is a block diagram showing an electric configuration of components relevant to a control on the transfer unit in the image forming apparatus 100.

A CPU 50 controls the whole image forming apparatus 100 including the transfer unit 25. In controlling the transfer unit 25, a read only memory (abbreviated as ROM) 61 stores a transfer unit control program for operating the driving roller 32, etc., a photoreceptor control program for rotation control of the photoreceptor drum 21, an image forming program for image forming operation, and the like program. A random access memory (abbreviated as RAM) 62 temporarily stores data required for operation according to the above programs.

A life management section 63 counts up the number of printed copies, the revolving speed of the transfer belt 31, or the like element, and stores cumulative total values (life count values) of these elements, thereby managing usage of expendables such as a toner. A display 64 is mounted in an operation panel or the like part of the image forming apparatus 100 and shows the operation menu, a message indicative of exchanging a toner cartridge, a message indicative of occurrence of paper jam, etc.

A photoreceptor driving section 65 is composed of a motor for rotating the photoreceptor drum 21 of which rotating speed is controlled by the CPU 50. A transfer belt driving section 66 is composed of a stepping motor for rotating the driving roller 32 in the transfer unit 25, and the running speed of the transfer belt 31 is controlled by the CPU 50.

The life count values and the running speed of the transfer belt 31, that is, the rotating speed of the driving roller 32, have been measured in advance as described above, and their correlation in form of a table, for example, may be stored in the life management section 63. When the speed control is required, the CPU 50 will look up the table to control the rotating speed of the driving roller 32.

Figure 4:
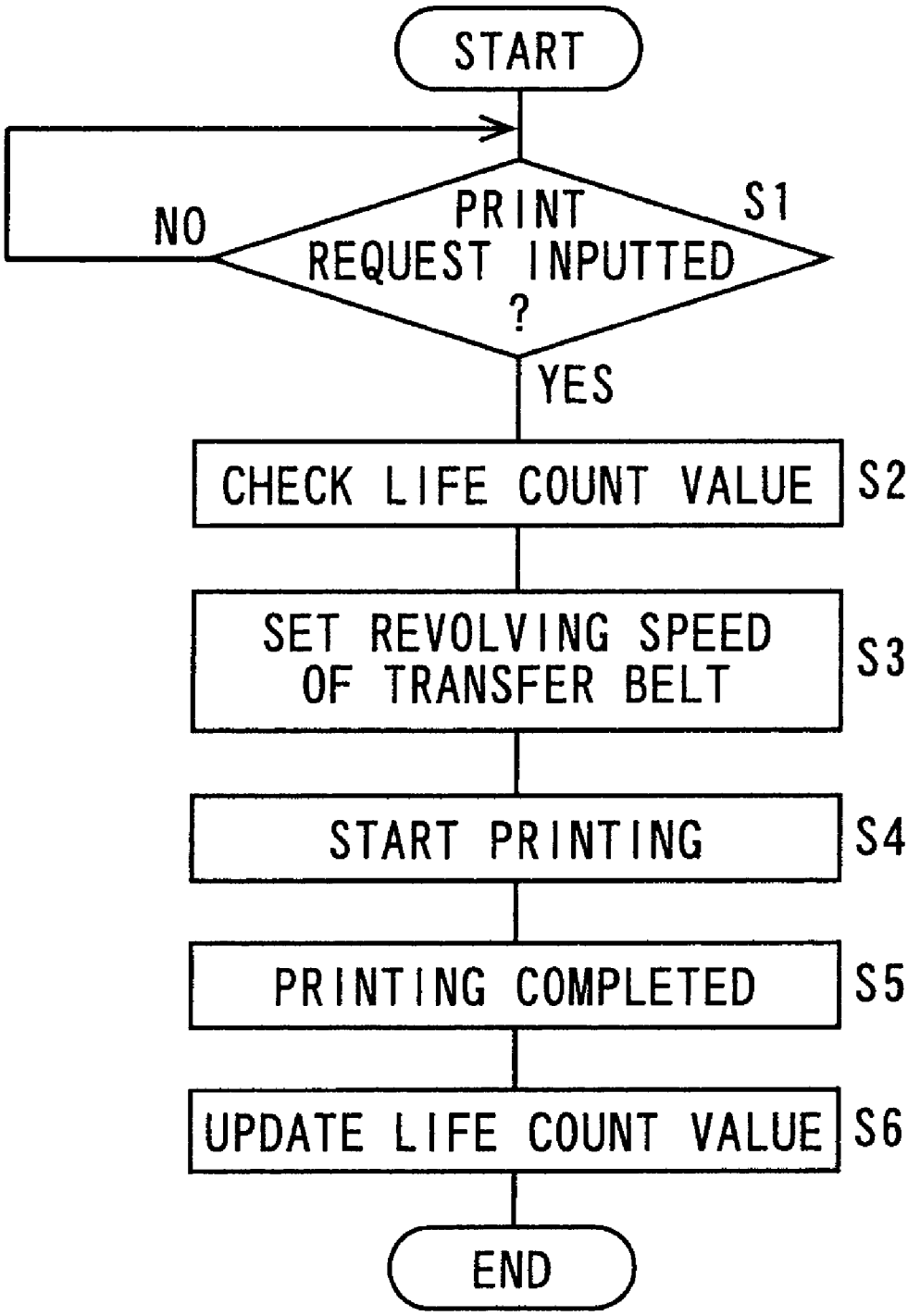
FIG. 4 is a flowchart showing a speed control process of the transfer unit.

FIG. 4 is a flowchart showing a speed control process of the transfer unit 25.

In Step S1, the transfer unit 25 idles until a user inputs a print request, and if a print job request is transmitted to the transfer unit 25, then the process goes to Step S2. In Step S2, the life count values stored in the life management section 63 are read out and checked.

In Step S3, the table of correlation between the life count values and the rotating speed of the driving roller 32 is looked up, and a rotating speed of the driving roller 32 corresponding to the life count values read out is determined at which the driving roller 32 is then set to rotate.

In Step S4, a printing process starts by rotating the driving roller 32 at the set speed so that the transfer belt 31 turns at a constant running speed. In Step S5, the requested printing process terminates and then in Step S6, the life count values are updated based on the number of printed copies and the revolving speed of the transfer belt 31.

As above, by increasing the rotating speed of the driving roller 32 according to the life count values, it is possible to control the transfer belt 31 to keep itself from losing speed in spite of the contact between the transfer belt 31 and the cleaning blade 38, thereby allowing for the transfer belt 31 to run at a constant speed.

As a result, no mismatching will be caused between the rotating speed of the photoreceptor drum 21 and the running speed of the transfer belt 31, allowing for a high-quality-image forming process without transfer misregistration.

Although the life count values are collectively updated in Step S6 after completion of the print job in the above description, the configuration is not limited thereto and the life count values may be sequentially updated after printing every single copy or after every single turning of the transfer belt 31.

In the above flow, the rotating speed of the driving roller 32 is controlled based on the life count values at the moment when the print job is inputted. On the other hand, if the life count values are sequentially updated, then the speed control is carried out by checking the life count values for every update and looking up the table of correlation, thus allowing for more complete control. Especially in the case where a great number of copies are to be printed according to an inputted print job, it may possibly become necessary to increase the rotating speed of the driving roller 32 in the middle of one print job processing to keep the transfer belt 31 from losing speed, and it is therefore preferable to control the speed during one print job processing.

Alternatively, the speed control may be carried out for every predetermined increases in the life count values; for example, for every 100-sheet increase in the number of printed copies or for every 100-turn increase in the revolving speed of the transfer belt 31.

Although the monochrome image forming apparatus is taken as an example to describe the invention in the above embodiment, note that application of the invention is not limited to such the monochrome image forming apparatus but may be a color image forming apparatus forming toner images of plural colors or any other image forming apparatus as long as it employs a transfer belt or intermediate transfer belt which is cleaned by a cleaning blade.

EXAMPLES

Examples of the invention will be described hereinbelow.

Using a commercially-available image forming apparatus, 300K copies (where K represents 1,000) were printed and at the time, the revolving speed (rpm) of the transfer belt 31 was measured. A set revolving speed, which was to be maintained at a constant level, of the transfer belt 31 was determined at 2,510 rpm.

Figure 5:
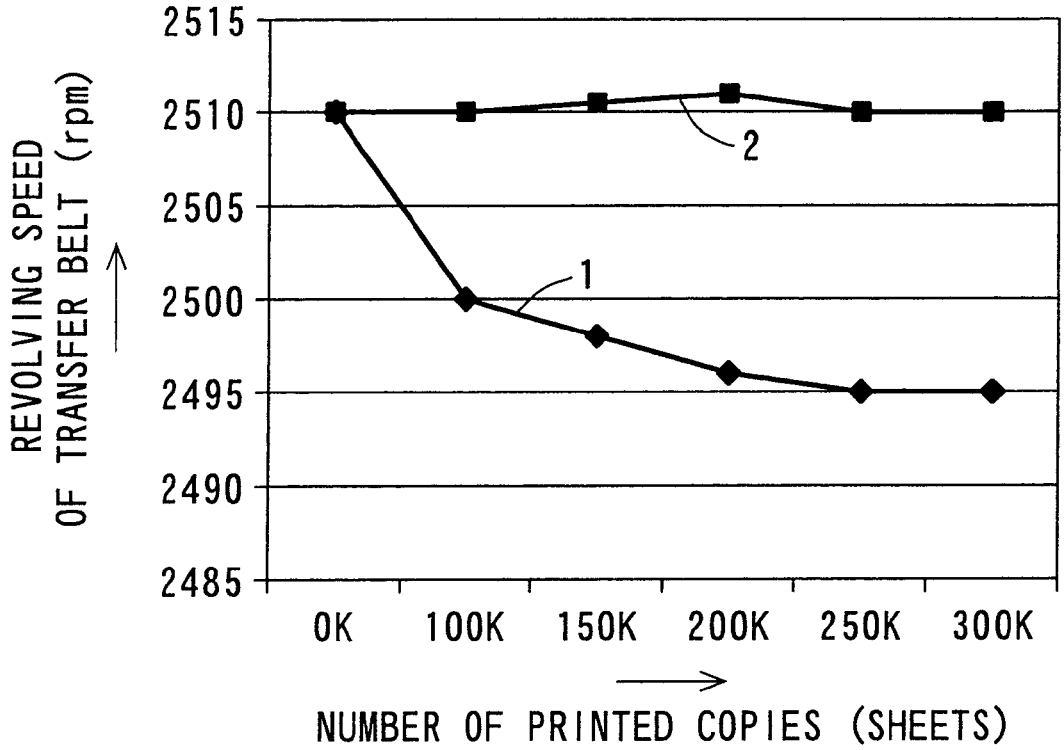
FIG. 5 is a graph showing a relation between the number of printed copies and the revolving speed of a transfer belt.

FIG. 5 is a graph showing a relation between the number of printed copies and the revolving speed of the transfer belt. This graph shows the number of printed copies (sheets) on the horizontal axis with the revolving speed (rpm) of the transfer belt on the vertical axis.

At the outset, printing was done without speed control and a rate of decrease in speed was measured. The measurement result is plotted as a graph 1. It shows that the revolving speed of the transfer belt is lower as more copies are printed.

On the basis of the measurement result, difference from the set revolving speed of 2,510 rpm was calculated and defined as a correction value.

For example, when 300K copies had been printed, an actual measurement value of the revolving speed was 2,495 rpm, and a difference thereof from the set revolving speed of 2,510 rpm was therefore 15 rpm by evaluating the expression 2510-2495. Then, the correction value was determined as 0.60% by evaluating the expression 15/2495×100. The correction value may be used to control the rotating seed of the driving roller 32 so that the revolving speed of the transfer belt is higher by 0.60% with the life count value of 300K copies.

Referring to the actual measurement values, it is possible to create a table of correlation between the correction values and the number of printed copies serving as the life count value. Table 1 is one example of such tables of correlation.

TABLE 1

| | The number of printed copies (sheets) | | | | | |
|---|---|---|---|---|---|---|
| | 0K | 100K | 150K | 200K | 250K | 300K |
| Correction values | 0% | 0.40% | 0.50% | 0.60% | 0.60% | 0.60% |

The measurement result obtained in the case of printing under speed control based on the correction values as above is plotted as a graph 2. It shows that the transfer belt is able to maintain a constant revolving speed in spite of an increasing number of printed copies.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising a transfer unit for transferring to a recording medium a toner image developed on a photoreceptor, the transfer unit having a transfer belt conveying the recording medium, and the image forming apparatus comprising:

a cleaning section for cleaning a surface of the transfer belt by coming into contact therewith; and a control section for controlling a running speed of the transfer belt based on a change in frictional force due to abrasions at a contact portion between the transfer belt and the cleaning section, wherein the control section:

stores a decrease of a running speed of the transfer belt due to an increase of frictional force between the transfer belt and the cleaning blade caused by a decrease of a surface roughness of the transfer belt, as a correlation with a predetermined cumulative number of printed copies or a running distance of the transfer belt;

controls a driving roller of the transfer belt so that its revolving speed becomes a predetermined speed according to a cumulative number of printed copies and a running distance; and controls the transfer belt so that its running speed becomes equal to a circumferential speed of the photoreceptor.

2. The image forming apparatus of claim 1, wherein the control section controls the running speed based on a correlation among the change in frictional force, a cumulative number of printed copies, and a distance that the transfer belt has run.

3. The image forming apparatus of claim 1, wherein the control section controls the running speed for every predetermined increase in a cumulative number of printed copies or for every predetermined increase in a running distance of the transfer belt.

4. The image forming apparatus of claim 1, wherein the control section controls the transfer belt so that its running speed becomes equal to a circumferential speed of the photoreceptor.

5. The image forming apparatus of claim 1, wherein the transfer belt is composed of an endless belt member, and the running speed of the transfer belt is a revolving speed of the transfer belt.

6. The image forming apparatus of claim 1, wherein the cleaning section has a plate-shaped cleaning blade made of urethane rubber and performs cleaning by bringing the cleaning blade into contact with the transfer belt.

7. An image forming apparatus comprising a transfer unit for transferring to a recording medium a toner image developed on a photoreceptor, the transfer unit having a transfer belt conveying the recording medium, and the image forming apparatus comprising:

a cleaning section for cleaning a surface of the transfer belt by coming into contact therewith; and a control section for controlling a running speed of the transfer belt based on a change in contact condition of the transfer belt and the cleaning section due to abrasions, wherein the control section:

stores a decrease of a running speed of the transfer belt due to a change in contact condition between the transfer belt and the cleaning blade caused by a decrease of a surface roughness of the transfer belt, as a correlation with a predetermined cumulative number of printed copies or a running distance of the transfer belt;

controls a driving roller of the transfer belt so that its revolving speed becomes a predetermined speed according to a cumulative number of printed copies and a running distance; and controls the transfer belt so that its running speed becomes equal to a circumferential speed of the photoreceptor.

* * * * *